US011076647B2

(12) United States Patent
Gudalis

(10) Patent No.: US 11,076,647 B2
(45) Date of Patent: Aug. 3, 2021

(54) PADS WITH THREE DIMENSIONAL IMAGE ELEMENT

(71) Applicant: 3DCALZ, LLC, Lexington, KY (US)

(72) Inventor: Brian Michael Gudalis, Lexington, KY (US)

(73) Assignee: 3DCalz, LLC, Lexington, KY (US)

( * ) Notice: Subject to any disclaimer, the term of this patent is extended or adjusted under 35 U.S.C. 154(b) by 0 days.

(21) Appl. No.: 15/888,866

(22) Filed: Feb. 5, 2018

(65) Prior Publication Data

US 2018/0325192 A1 Nov. 15, 2018

Related U.S. Application Data

(63) Continuation-in-part of application No. 15/425,870, filed on Feb. 6, 2017, now abandoned, which is a (Continued)

(51) Int. Cl.
*A41B 11/00* (2006.01)
*A41B 11/02* (2006.01)
(Continued)

(52) U.S. Cl.
CPC ..... *A41D 13/0543* (2013.01); *A41B 11/001* (2013.01); *A41B 11/02* (2013.01); *A41D 13/0156* (2013.01); *A41D 13/0562* (2013.01); *A41D 13/0568* (2013.01); *A41D 27/08* (2013.01); *A63B 71/1225* (2013.01); *A63B 71/12* (2013.01); *A63B 2071/0694* (2013.01);
(Continued)

(58) Field of Classification Search
CPC ..... A41D 13/0543; A41D 13/0156; A41D 27/08; A41B 11/001; A41B 11/02
USPC ..... 2/22
See application file for complete search history.

(56) References Cited

U.S. PATENT DOCUMENTS 2,544,065 A 3/1951 Carr
2,629,094 A 2/1953 Goldsmith
(Continued)

FOREIGN PATENT DOCUMENTS

WO WO 01/87432 11/2001

OTHER PUBLICATIONS

"Reebok HP5K Breezers"; Play It Again Sports, Jan. 29, 2013; web search, one page.
(Continued)

*Primary Examiner* — Alissa J Tompkins
*Assistant Examiner* — Catherine M Ferreira
(74) *Attorney, Agent, or Firm* — Knobbe Martens Olson & Bear LLP

(57) ABSTRACT

A shin guard includes a protective plate having a front face and a rear face. The rear face is contoured to fit around a shin of a wearer of the shin guard. Further, the shin guard includes a three dimensional image element carried on the front face. This image element projects an image outline through a sock worn over the shin guard. A sports pad is provided including an outer shell defining a pocket and a pad received and held in the pocket. A three dimensional image element is captured between said outer shell and the front face of the pad. That image element projects an image outline through the outer shell to enhance the uniform of the player wearing the sports pad.

19 Claims, 10 Drawing Sheets

Related U.S. Application Data continuation of application No. 14/614,936, filed on Feb. 5, 2015, now abandoned, which is a continuation-in-part of application No. 14/050,439, filed on Oct. 10, 2013, now abandoned, application No. 15/888,866, which is a continuation-in-part of application No. 14/207,981, filed on Mar. 13, 2014, now Pat. No. 9,884,240, which is a continuation-in-part of application No. 14/050,439, filed on Oct. 10, 2013, now abandoned.

(60) Provisional application No. 61/936,988, filed on Feb. 7, 2014, provisional application No. 61/798,583, filed on Mar. 15, 2013, provisional application No. 61/723,177, filed on Nov. 6, 2012, provisional application No. 61/755,208, filed on Jan. 22, 2013.

(51) Int. Cl.

| | |
|---|---|
| ***A41D 13/05*** | (2006.01) |
| ***A63B 71/12*** | (2006.01) |
| ***A41D 27/08*** | (2006.01) |
| ***A41D 13/015*** | (2006.01) |
| *A63B 71/06* | (2006.01) |

(52) U.S. Cl.

CPC . *A63B 2071/125* (2013.01); *A63B 2071/1258* (2013.01); *A63B 2209/10* (2013.01)

(56) References Cited

U.S. PATENT DOCUMENTS

| | | | | | |
|---|---|---|---|---|---|
| 2,717,387 | A | | 9/1955 | Mcmahan | |
| 3,553,062 | A | * | 1/1971 | Berlin | B44C 3/025 428/21 |
| 3,629,034 | A | * | 12/1971 | Kuroda | B29C 66/1122 156/219 |
| 4,209,354 | A | * | 6/1980 | Kuroda | B32B 3/28 156/219 |
| 4,285,338 | A | * | 8/1981 | Lemelson | A61F 13/0203 128/889 |
| 4,455,686 | A | | 6/1984 | Zide | |
| 4,479,269 | A | | 10/1984 | Balliet | |
| 4,591,521 | A | | 5/1986 | Freno et al. | |
| 4,914,753 | A | * | 4/1990 | Chang | A41D 13/0568 2/24 |
| 5,079,778 | A | | 1/1992 | Sloot | |
| 5,334,135 | A | | 8/1994 | Grim | |
| 5,423,087 | A | * | 6/1995 | Krent | A41D 13/0156 2/463 |
| 5,671,478 | A | | 9/1997 | Yen | |
| 5,742,938 | A | * | 4/1998 | Winningham | A63B 71/1225 2/22 |
| 5,896,580 | A | * | 4/1999 | Aldrich | A41D 13/065 2/22 |
| 5,933,866 | A | | 8/1999 | Fox | |
| 5,978,962 | A | * | 11/1999 | Hamowy | A41D 13/0568 2/16 |
| 6,000,147 | A | * | 12/1999 | Kellerman | A43B 7/142 36/160 |
| 6,014,771 | A | | 1/2000 | Kirven | |
| 6,322,866 | B1 | * | 11/2001 | Sloot | B32B 3/00 2/246 |
| RE37,533 | E | | 1/2002 | Beige et al. | |
| 6,443,081 | B1 | | 9/2002 | Quint | |
| 6,532,599 | B1 | | 3/2003 | Dugan | |
| 7,003,803 | B1 | | 2/2006 | Lyden | |
| 7,517,331 | B2 | | 4/2009 | Reinhardt | |
| D656,278 | S | | 3/2012 | Saranga et al. | |
| D684,323 | S | | 6/2013 | Macrina et al. | |
| 8,765,257 | B2 | * | 7/2014 | Weedlun | D06P 5/12 428/343 |
| 8,834,974 | B1 | * | 9/2014 | Ferry | B41M 5/0011 428/32.79 |
| 2003/0017291 | A1 | * | 1/2003 | Fleming | C09J 7/403 428/40.1 |
| 2003/0163076 | A1 | | 8/2003 | Lukens | |
| 2006/0156455 | A1 | | 7/2006 | Teixeira | |
| 2006/0156456 | A1 | | 7/2006 | Teixeira | |
| 2006/0179538 | A1 | | 8/2006 | Dodd | |
| 2008/0113143 | A1 | | 5/2008 | Taylor | |
| 2010/0024089 | A1 | * | 2/2010 | Turner | A41D 13/015 2/23 |
| 2010/0183814 | A1 | * | 7/2010 | Rios | C08L 83/04 427/387 |
| 2010/0192269 | A1 | * | 8/2010 | Saranga | A41D 13/0543 2/24 |
| 2010/0226943 | A1 | * | 9/2010 | Brennan | A41D 31/305 424/400 |
| 2011/0056004 | A1 | | 3/2011 | Landi | |
| 2011/0277226 | A1 | | 11/2011 | Turner | |
| 2011/0307998 | A1 | * | 12/2011 | Turner | A41D 13/05 2/455 |
| 2012/0297525 | A1 | | 11/2012 | Bain | |
| 2013/0139952 | A1 | * | 6/2013 | Baklanov | G09F 3/10 156/67 |
| 2017/0087924 | A1 | * | 3/2017 | Aihara | B44C 1/1716 |

OTHER PUBLICATIONS

International Search Report and Written Opinion for International Application No. PCT/US2013/068440 dated May 1, 2014.

International Preliminary Report on Patentability dated May 12, 2015 in PCT/US2013/068440.

Extended European Search Report dated Oct. 16, 2016 in patent application No. 13853756.8.

* cited by examiner

PADS WITH THREE DIMENSIONAL IMAGE ELEMENT

This application is a continuation-in part of U.S. patent application Ser. No. 15/425,870, filed on Feb. 6, 2017, which is a continuation of U.S. patent application Ser. No. 14/614,936, filed on Feb. 5, 2015, which is a continuation-in-part of U.S. patent application Ser. No. 14/050,439, filed on Oct. 10, 2013, which claims the benefit of U.S. Provisional Patent Application Ser. No. 61/723,177, filed on Nov. 6, 2012, and 61/755,208 filed on Jan. 22, 2013. Further, U.S. patent application Ser. No. 14/614,936 claims the benefit of U.S. Provisional Patent Application Ser. No. 61/936,988, filed on Feb. 7, 2014. This application is also a continuation-in-part of U.S. patent application Ser. No. 14/207,981, filed on Mar. 13, 2014, which is scheduled to issue as U.S. Pat. No. 9,884,240, on Feb. 6, 2018, which is a continuation-in-part of U.S. patent application Ser. No. 14/050,439, filed on Oct. 10, 2013, which claims the benefit of priority in U.S. Provisional Patent Application Ser. No. 61/723,177, filed on Nov. 6, 2012, and U.S. Provisional Patent Application Ser. No. 61/755,208, filed on Jan. 22, 2013. Further, U.S. patent application Ser. No. 14/207,981 claims the benefit of priority of U.S. Provisional Patent Application Ser. No. 61/798,583, filed on Mar. 15, 2013. The full disclosure of each of these documents is incorporated herein by reference. Any and all applications for which a foreign or domestic priority claim is identified in the Application Data Sheet as filed with the present application are hereby incorporated by reference under 37 CFR 1.57.

TECHNICAL FIELD

This document relates generally to the sports equipment field and, more particularly, to soccer shin guards and elbow and knee pads including a three dimensional image element for projecting a desired image outline.

BACKGROUND

Soccer players commonly wear shin guards in order to protect their shins from contact during soccer practice and matches. This document relates to a shin guard that incorporates a three dimensional image element which projects an image outline of a desired shape, such as a player number or team logo, that enhances the team uniform.

SUMMARY

In accordance with the purposes and benefits described herein, a shin guard is provided. That shin guard comprises a protective plate having a front face and a rear face. The rear face is contoured to fit around the shin of a wearer of the shin guard. Further, the shin guard includes a three dimensional image element carried on the front face of the protective plate.

That image element may take on any desired shape. In one possible embodiment, the image element is in the shape of a player number. In another possible embodiment, the image element is in the shape of a logo.

In one possible embodiment, the three dimensional image element is tapered outwardly from a central area toward an outer edge so that the central area projects a greater distance from the front face than does the outer edge. For many images, this contouring enhances the image produced by the image element through a sock covering.

In one possible embodiment, the shin guard includes a fastener for securing the protective plate to the shin of the wearer. That fastener may take the form of a strap. That strap may include a hook and loop fastener. In other embodiments, the fastener may take the form of a sleeve of elastic material.

In one possible embodiment, the shin guard further includes an ankle pad depending from the protective plate so as to overlie the ankle when the shin guard is being worn. In one possible embodiment, the shin guard further includes a foot loop for securing the shin guard around a foot below the protective plate.

In one possible embodiment, the three dimensional image element is a discrete body releasably attached to the front face of the protective plate. Thus, for example, the three dimensional image element may be attached to the front face by a hook and loop fastener. In another possible embodiment, the three dimensional image element is a discrete body secured to the front face by an adhesive. In yet another possible embodiment, the three dimensional image element is integrally formed as a permanent part of the protective plate as a single piece construction.

In the following description, there are shown and described several preferred embodiments of the shin guard. As it should be realized, the shin guard is capable of other, different embodiments and its several details are capable of modification in various, obvious aspects all without departing from the shin guard as set forth and described in the following claims. Accordingly, the drawings and descriptions should be regarded as illustrative in nature and not as restrictive.

In another aspect, a sports pad comprises an outer shell defining a pocket and a pad received and held in the pocket. The pad has a front face. A three dimensional image element is carried on the front face of the pad. That image element projects an image outline through the outer shell.

That image outline may take on any desired shape. In one possible embodiment the image element is in the shape of a player number. In another possible embodiment the image element is in the shape of a logo.

In one possible embodiment the three dimensional image element is provided on a background sheet. In one possible embodiment the three dimensional image element is tapered outwardly from a central area toward an outer edge so that the central area projects a greater distance from the front face of the pad than does the outer edge.

In accordance with another aspect, the pad further includes a fastener for securing the pad to a limb of an individual wearing the pad. In one possible embodiment the fastener is a partial or full elastic sleeve. In another possible embodiment the fastener includes at least one elongated strap and a cooperating hook and loop fastening device. In one possible embodiment the pad is configured to protect and be worn over a knee. In another possible embodiment the pad is configured to protect and be worn over an elbow.

In one possible embodiment the outer shell is a first color and the three dimensional image element is a second color. In one possible embodiment the first and second colors contrast. In another possible embodiment the three dimensional image element is provided on a background sheet and the three dimensional image element is a first color, the background sheet is a second color and the outer shell is a third color. In one possible embodiment the first, second and third colors are all different. In another possible embodiment the second and third colors are the same and the first color is different. In another possible embodiment the first and third colors are the same and the second color is different.

In yet another possible embodiment the three dimensional image element and the front face are different colors. In yet another possible embodiment the three dimensional image element and the front face are the same color.

In accordance with an additional aspect a method of promoting a sports team is provided. That method comprises equipping a player on the sports team with a sports pad including a three dimensional image element that projects an image outline of a logo. In one embodiment that method further includes wearing the pad on a knee. In another embodiment that method further includes wearing the pad on an elbow.

These and other embodiments will be set forth in the description which follows and in part will become apparent to those of ordinary skill in the art by reference to the following description and drawing figures.

BRIEF DESCRIPTION OF THE DRAWING FIGURES

The accompanying drawing figures incorporated herein and forming a part of the specification, illustrate several aspects of the shin guards and sports pads and together with the description serve to explain certain principles thereof. In the drawing figures.

Reference will now be made in detail to the present preferred embodiments of the shin guard, examples of which are illustrated in the accompanying drawing figures.

DETAILED DESCRIPTION

Sports enthusiasts including, for example, soccer and volleyball players, commonly wear padding on their shins, elbows, and knees in order to protect their shins, elbows and knees from contact with hard surfaces such. This document relates to sports pads for shins, knees, and elbows that incorporate a three dimensional image element which projects an image outline of a desired shape such as a player number or team logo that enhances the team uniform.

Figure 1:
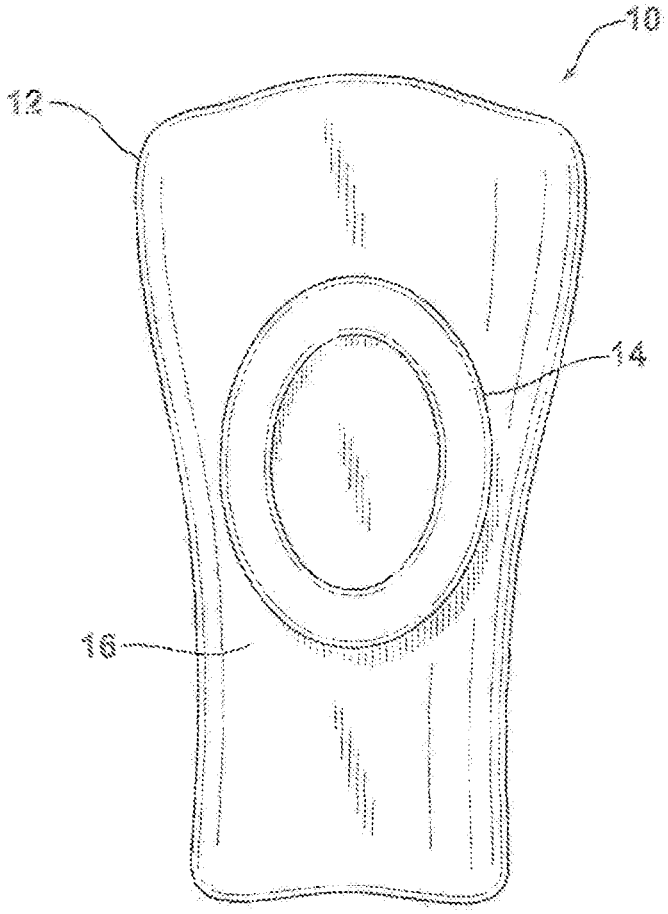
FIG. 1 is a front elevational view of a shin guard including the protective plate and a three dimensional image element carried on the front face of the protective plate.

Reference is now made to FIG. 1 illustrating a first embodiment of a shin guard 10. As illustrated, the shin guard 10 includes a protective plate 12 and a three dimensional image element 14 carried on the front face 16 of the protective plate. The protective plate 12 may comprise, for example, a molded piece of high strength plastic material.

Figure 2:
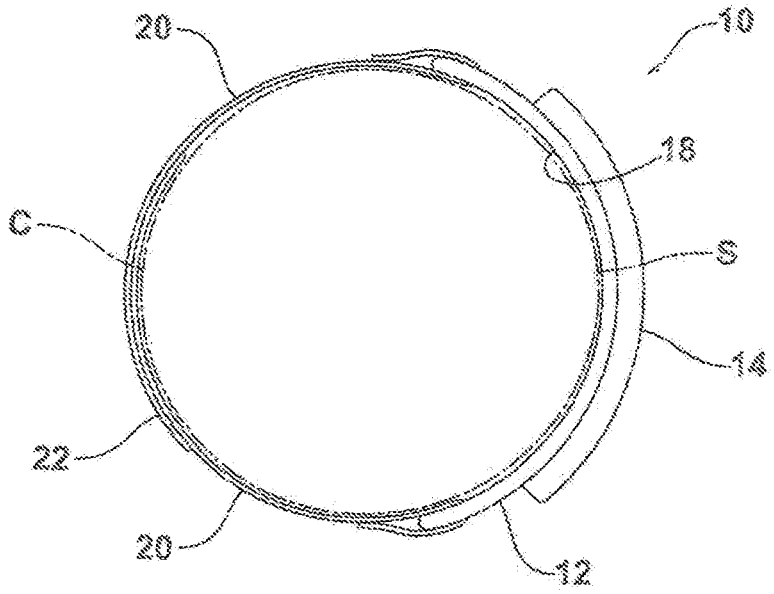
FIG. 2 is a top plan view of one possible embodiment of the shin guard showing how the protective plate is contoured to fit around the shin of a wearer and further showing a strap with optional hook and loop fastener extending around the calf and fastening the shin guard over the shin of the wearer.

As illustrated in the FIG. 2 embodiment, the shin guard 10 is worn to protect the shin S of a player from contact injury. Toward this end, the rear face 18 of the protective plate 12 is contoured to fit around the shin S of the wearer. The protective plate 12 is secured overlying the shin S by a strap 20 that is connected at its ends to opposite sides of the protective plate 12 and extends around behind the calf C of the wearer. In the illustrated embodiment, the strap 20 includes an adjustable hook and loop fastener 22. In other embodiments, the strap 20 may simply be a continuous strap of elastic material.

Figure 3:
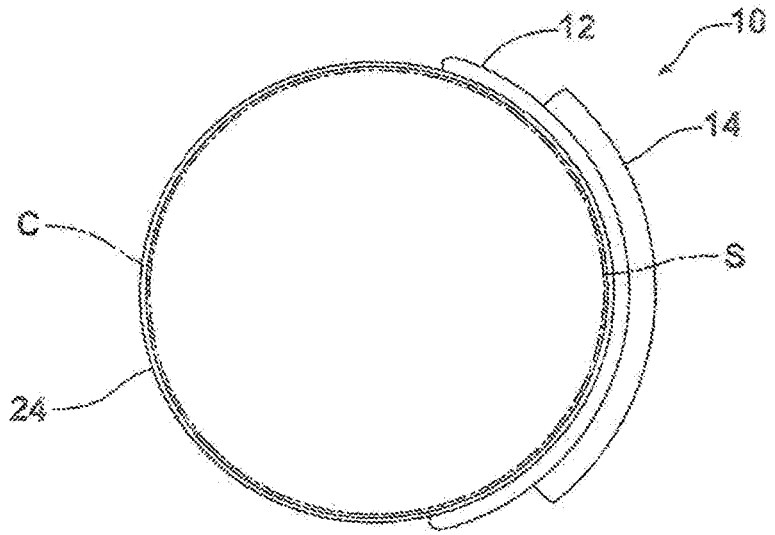
FIG. 3 is a top plan view similar to FIG. 2 but showing an alternative embodiment incorporating an elastic sleeve fastener instead of the strap.

In the embodiment of shin guard 10 illustrated in FIG. 3, the protective plate 12 is held in proper position overlying the shin S by means of a sleeve 24 of elastic material. As should be appreciated, that sleeve 24 extends continuously around the calf C from each side of the protective plate 12. In this embodiment, the shin guard 10 is pulled on over the foot like a sock.

Figure 4:
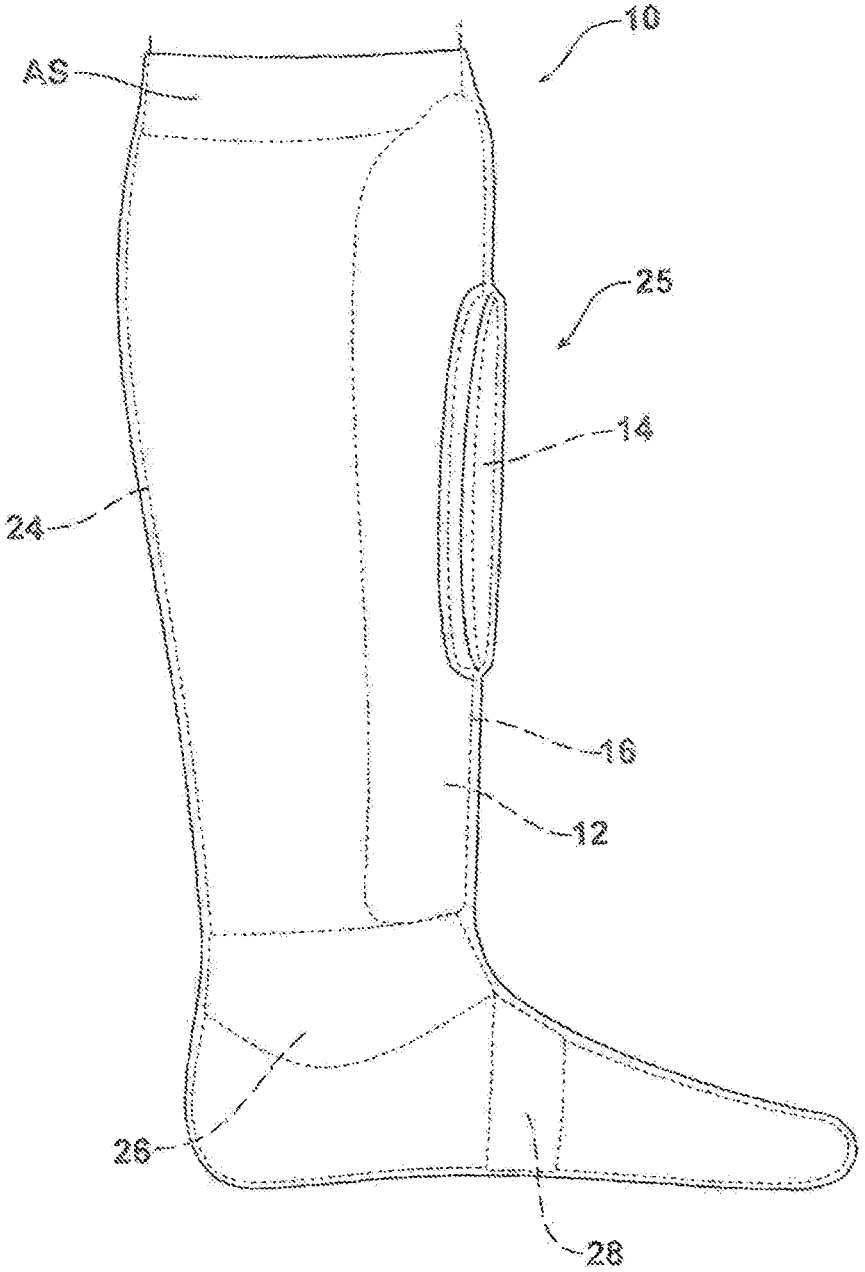
FIG. 4 is a side elevational view of yet another embodiment of the shin guard including a protective plate, an elastic sleeve, an ankle pad and a foot loop for securing the shin guard at the bottom to the foot of the wearer.

In the embodiment of shin guard 10 illustrated in FIG. 4, the protective plate 12 is held in position over the shin S by an elastic sleeve 24 just as illustrated in FIG. 3. In addition, the shin guard 10 includes an ankle pad 26 depending downwardly towards the foot from the protective plate 12 and sleeve 24. In addition, an elastic foot loop 28 extends from the ankle pad 26 around the foot F of the wearer. An athletic sock AS overlies the shin guard 10 and the image element 14 forms an image outline 25 in the sock.

As should be appreciated, all of the embodiments illustrated in FIGS. 1-4 include the three dimensional image element 14. The three dimensional image element 14 may be a discrete body that is releasably attached to the front face 16 of the protective plate 12. Thus, the image element 14 may be attached to the front face 16 by means of, for example, a hook and loop fastener. Such a connection allows one to change the image element 14 at any desired time from, for example, a player number to a team logo. In an alternative embodiment, the discrete image element 14 may be more permanently attached to the front face 16 of the protective plate 12 by means of an appropriate adhesive. In yet another possible embodiment, the three dimensional image element 14 is integrally formed as a permanent part of the protective plate 12 as a single piece construction. This could be done by molding or other means.

In any of the embodiments, the three dimensional image element 14 may take the shape and form of any desired image including, but not limited to, a player's number and a logo. For purposes of this document, the term "logo" refers to letters, words, numbers, names, trademarks, mascots, images, stripes, designs and other three dimensional shapes that may commonly identify or are used by athletic teams, athletes and individuals.

The three dimensional image element 14 may be solid, hollow, an outline or a combination. For example, to form a "shamrock" logo, the shape of the shamrock may be cut out of a 3 mm thick piece of foam. The cut out shamrock could be pulled from the foam and adhered to the protective plate 12. The resulting image outline produced by the image element 14 in an overlying athletic sock AS would appear as a solid shamrock. In addition, the outline of the shamrock that remains in the foam can be used to show the image outline of a shamrock but instead of it being full, it is an outline of a shamrock or a hollow three dimensional image. Obviously, different widths and colors of foam may be utilized to create varying images, shadows and appearances including complex images such as an American flag.

Figure 5:
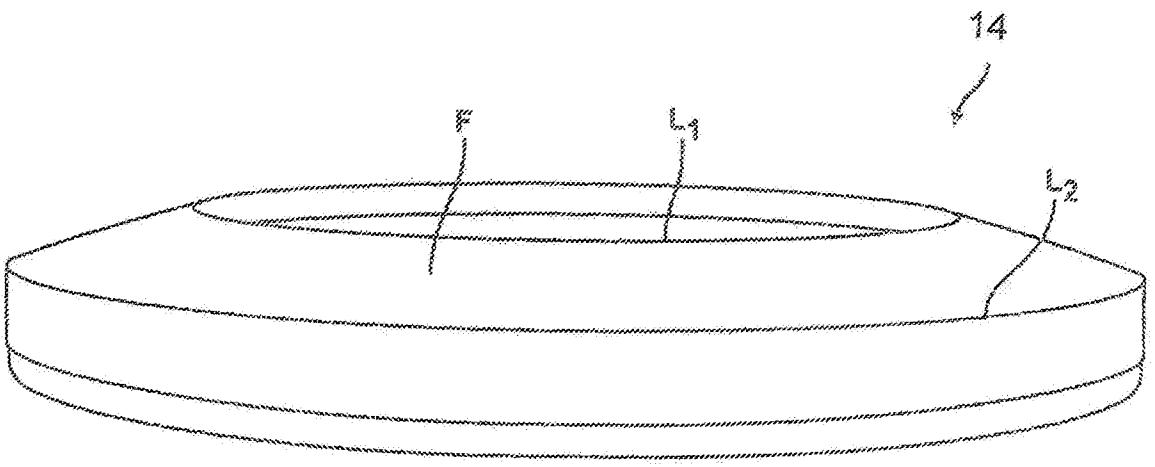
FIG. 5 is a perspective view illustrating the tapering of a three dimensional image element from an area of greatest height or thickness at a central portion thereof to an area of the lowest height or thickness at an outer edge thereof.

For some images, the three dimensional image element is the same thickness throughout. However, the depth of the three dimensional image element may be manipulated to give the image outline more or less detail and definition when it projects through the exposed fabric area overlying the image element. For example, as illustrated in FIG. 5, while a three dimensional image element 14 of a "O" can be seen as a "O" if the entire "O" is 3 mm thick, forming the inside line $L_1$ of the "O" slightly higher than the outside line $L_2$ to create a sloped face F allows the inner circle of the "O" to show differently/more prominently and this can give it a different detail when it is seen through the clothing covering the image element. Further there are various ways to manipulate an "O" to make it appear differently while ensuring that it is an "O". For example it can be made a perfect circle or an oval. It can be made flat versus wavy. It can be made using only the outlines of the inside and outside circles. For some images, but not all, the inside lines must be made slightly higher than those on the outside in order for the details to show through the sock covering the image element 14. Also using rounded edges can help give definition. For example an American flag can be made by rounding the red strips of the flag, omitting the white stripes, making the blue a rectangle with square edges and adding slightly raised dots for the stars. This is an example of how different processes and shaping can be used to form a three dimension image element 14 that provides the desired image outline projecting through the exposed fabric area of the sock covering the element.

The three dimensional image element 14 may be made from a number of different materials including, but not limited to foams, high density synthetic materials, foam rubbers and plastics. Particularly useful foam materials include polyethylene foam, polypropylene foam and PVC foam. Regardless of the chemical makeup it is preferred that the foam be a "closed cell" foam. In some instances the three dimensional image element 14 is made from the same material as the protective plate 12 to which it is attached so that it may be used in athletic events without increasing any risk in injury. In fact, as previously noted, the image element 14 may even be molded with the plate 12 so that the two form a unitary construction.

As should be appreciated, the three dimensional image element 14 may be punched or cut from a sheet of foam as previously described. Alternatively, the three dimensional image element 14 may be molded in a mold. The production operation utilized depends on the material being formed into an image and the intended use of the image. Logos, like college logos, mascots or trademarks could be punched or cutout from the foam. Logos such as single or entwined letters like an "S", "OU", "NC", "ND", "UK", "3C", etc. show through and produce the desired image whether they are solid letters, outlined letters or a combination of both. Logo images such as an eagle and cat's paw may also be easily produced.

Images or logos formed in molds may be given additional detail in certain areas that is not possible with a simple punching operation. For example, molds may help when forming rounded portions, edges and crevices. This allows the three dimensional image element 14 to produce an image outline that is often times significantly more detailed in appearance from a simple punched image. Forming the image in a mold may help give varying depths within the same image so as to make it look more realistic and provide a desired hologram-like affect to the image outline.

It should also be appreciated that the three dimensional image element 14 may be made in multiple sizes. Obviously, they can also be made of different colors depending on the desired effect. Only a portion of the entire three dimensional image element 14 may include one or more colors to enhance the image as it projects or appears through the exposed fabric area overlying the image element.

Color may be used to enhance the three dimensional effect and the produced image outline. In one possible embodiment, the sock AS worn over the image element 14 is a first color and the three dimensional image element is a second, contrasting color. In one particularly useful embodiment the sock is white or other relatively light color while the three dimensional image element 14 is a darker, contrasting color. This contrasting color arrangement has a tendency to enhance the 3D or holographic effect provided to the image outline 25 visible in the sock AS.

Reference is now made to FIGS. 6-9 illustrating a sports pad 110 including an outer shell 112 that defines a pocket 114 for receiving and holding a pad 116. A three dimensional image element 118 is captured between the pad 116 and the part of the shell 112 forming the pocket 114. In the illustrated embodiment the image element 118 is carried on the front face 120 of the pad 116.

As should be appreciated, the three dimensional image element 118 projects an image outline 122 through the outer shell 112 which is made from a fabric material commonly employed in the construction of knee and elbow pads. More specifically, the portion 115 of the outer shell 112 overlying and engaging the image element 118 conforms to the shape of the image element. That image outline 122 may take the shape and form of any desirable image including, but not limited to, a player number and a logo. For purposes of this document, the term "logo" refers to letters, words, numbers, names, trademarks, mascots, images, stripes, designs and other three dimensional shapes that may commonly identify or be used by athletic teams, athletes and individuals.

Figure 6:
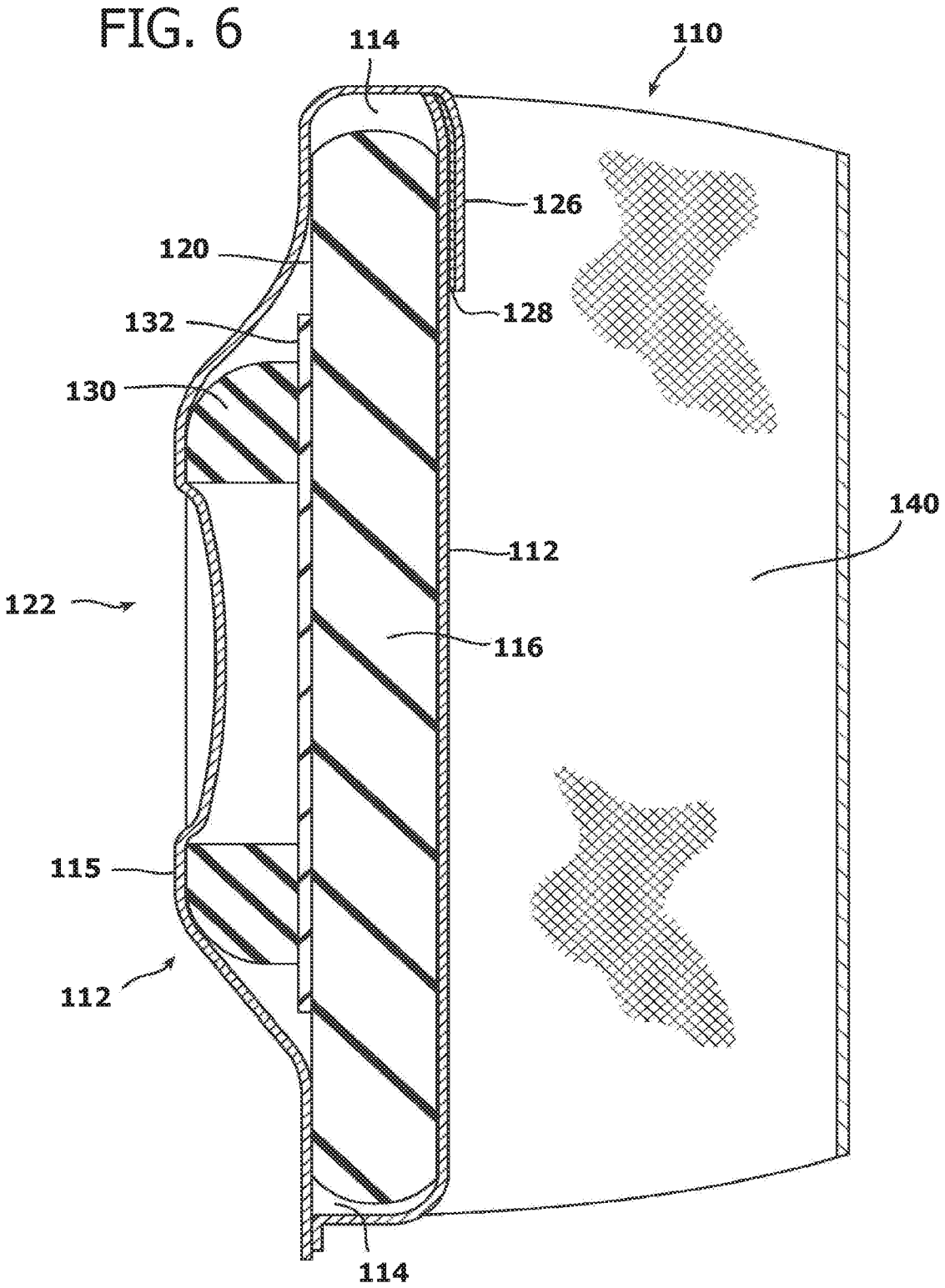
FIG. 6 is a cross-sectional view of a sports pad including an outer shell defining a pocket, a pad received and held in the pocket and a three dimensional image element carried on the front face of the pad so that the image element projects an image outline through the outer shell.

In one possible embodiment illustrated in FIG. 6, the pocket 114 may be opened or closed by means of a flap 126. When the flap 126 is open, the pad 116 may be removed from the pocket 114 for cleaning or to change or reposition the element 118 on the front face 120 of the pad 116. The pad 116, with the three dimensional element 118 in its proper position, may then be replaced in the pocket 114. The flap 126 is then folded over the top of the pad 116 and secured by hook and loop fastener 128 or other similar means to the outer shell 112 at the rear of the pad thereby closing the pocket 114 and securing the pad in position. It should be noted that the illustrated flap 126 is only one possible way of opening and closing a pocket 114 to hold the pad 116 and that the general concept of a sealable pocket is not to be considered as limited thereto.

Figure 7:
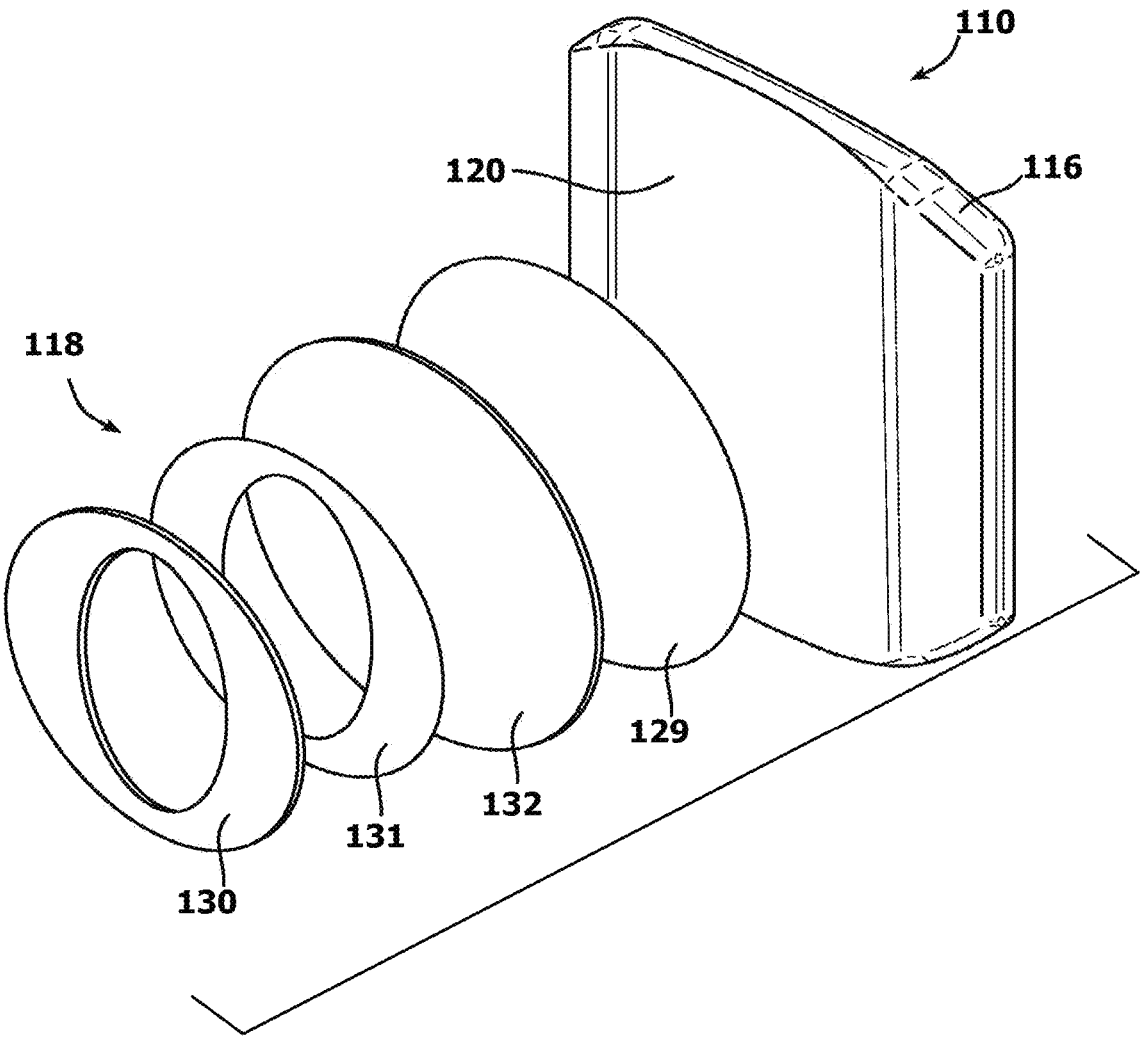
FIG. 7 is an exploded perspective view of the three dimensional image element on the pad.
Figure 8:
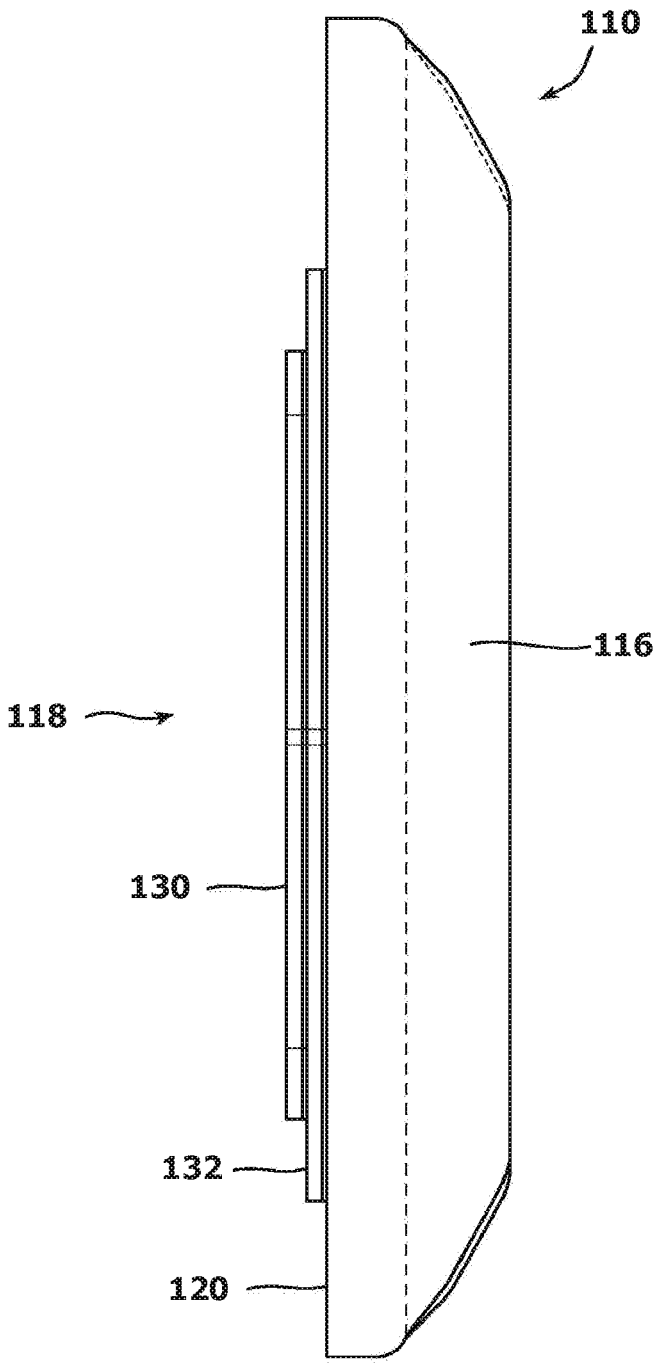
FIG. 8 is a side elevational view of the three dimensional image element connected to the pad.
Figure 9:
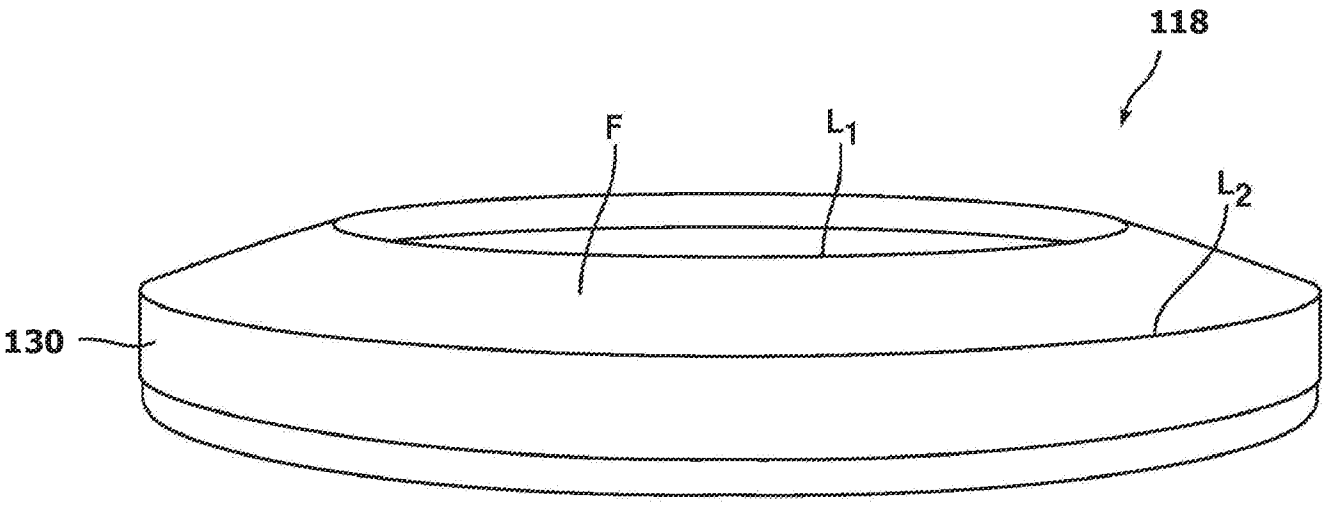
FIG. 9 is a perspective view illustrating the tapering of the three dimensional element from an area of greatest height or width at a central portion thereof to an area of lowest height or width at an outer edge thereof.

As best illustrated in FIGS. 7 and 8, the three dimensional image element 118 is secured to the front face 120 of the pad 116 by means of a fastener 129, such as a layer of adhesive or a hook and loop fastener system such as sold under the trademark VELCRO. The image 118 may include a three dimensional logo 130 alone or a combination of a logo 130 and background sheet 132 (note additional fastener 131) as illustrated that is mounted directly to the front face 120 of the pad 116. FIG. 7 illustrates an exploded view of the three dimensional image element 118 and the pad 116. As shown in FIG. 7, the three dimensional image element 118 includes the background sheet 132 having a front face and an opposite rear face. The three dimensional image element 118 also includes a three dimensional shape (logo 130) that is carried on the front face of the background sheet 132 with the fastener 131, which can be adhesive. That is, the fastener 131 attaches the logo 130 to the background sheet 132. The three dimensional image element 118 also includes a fastener 129 on the rear face of the background sheet 132. The fastener 129 can be a layer of adhesive. The fastener 129 can be configured to affix the three dimensional image element 118 to the front face 120 of the pad 116. FIG. 8 illustrates a combined logo 130 and background sheet 132 secured in position on the front face 120 of a pad 116. As shown, the surface area of the logo 130 is smaller than the surface area of the background sheet 132, such that the background sheet 132 forms a boarder around a perimeter of the logo 130.

The three dimensional image element 118 may be solid, hollow, an outline or a combination. For example, to form a "shamrock" logo the shape of the shamrock may be cut out of a 3 mm thick piece of foam. The cutout shamrock could be pulled from the foam and adhered to the pad 116. The resulting image outline 122 would appear as a solid shamrock. In addition, the outline of the shamrock that remains in the foam can then be used to show the image outline 122 of a shamrock but instead of it being full, it is an outline of a shamrock or a hollow three dimensional image. Obviously different widths and colors of foam may be utilized to create varying images, shadows and appearances including complex images such as an American flag.

For some images the logo 130 of the three dimensional image element 118 is the same thickness throughout. However, the depth of the logo 130 may be manipulated to give the image outline 122 more or less detail and definition when it projects through the exposed fabric area of the outer shell 112. For example, while a three dimensional image element 118 of a "O" can be seen as a "O" if the entire "O" is 3 mm thick, forming the inside line $L_1$ of the "O" slightly higher than the outside line $L_2$ to create a sloped face F allows the inner circle of the "O" to show differently and this can give it a different detail when it is seen through the clothing or outer shell covering 12 (See FIG. 9). Further there are various ways to manipulate an "O" to make it appear differently while ensuring that it is an "O". For example it can be made a perfect circle or an oval. It can be made flat versus wavy. It can be made using only the outlines of the inside and outside circles. For some images, but not all, the inside lines must be made slightly higher than those on the outside in order for the details to show through the outer shell 112. Also using rounded edges can help give definition. For example an American flag can be made by rounding the red strips of the flag, omitting the white stripes, making the blue a rectangle with square edges and adding slightly raised dots for the stars. This is an example of how different processes and shaping can be used to form a three dimension image element 18 that provides the desired image outline 122 projecting through the exposed fabric area of the outer shell 112.

The three dimensional image element 118 may be made from a number of different materials including, but not limited to foams, high density synthetic materials, foam rubbers and plastics. Particularly useful foam materials include polyethylene foam, polypropylene foam and PVC foam. Regardless of the chemical makeup it is preferred that the foam be a "closed cell" foam. In many instances the three dimensional image element 118 is made from the same material as the pad 110 to which it is attached so that it may be used in athletic events without increasing any risk in injury. In fact, the image element 18 may even be molded into the pad 116.

As should be appreciated the three dimensional image element 118 may be punched or cut from a sheet of foam as previously described. Alternatively, the three dimensional image element 118 may be molded in a mold. The production operation utilized depends on the material being formed into an image and the intended use of the image. Logos 130, like college logos, mascots or trademarks could be punched or cutout from the foam. Logos 130 such as single or entwined letters like an "5", "OU", "NC", "ND", "UK", "3C", etc. show through and produce the desired image 122 whether they are solid letters, outlined letters or a combination of both. Logo images 122 such as an eagle and cat's paw may also be easily produced.

Images or logos 130 formed in molds may be given additional detail in certain areas that is not possible with a simple punching operation. For example, molds may help when forming rounded portions, edges and crevices. This allows the three dimensional image element 118 to produce an image outline 122 that is often times significantly more detailed in appearance from a simple punched image. Forming the image in a mold may help give varying depths within the same image so as to make it look more realistic and provide a desired hologram-like affect to the image outline 122.

It should also be appreciated that the three dimensional image element 118 may be made in multiple sizes to fit different sized items. For example, a three dimensional image element 118 of an eagle could be 12.7 cm wide to fit across a knee pad or 10.0 cm wide to fit on a smaller elbow pad. Obviously, they can also be made of different colors depending on the desired effect. Only a portion of the entire three dimensional image element 118 may include one or more colors to enhance the image as it projects or appears through the exposed fabric area of the outer shell 112 overlying the image element.

Color may be used to enhance the three dimensional effect and the produced image outline 122. In one possible embodiment the outer shell 112 is a first color and the three dimensional image element 118 is a second, contrasting color. In one particularly useful embodiment the outer shell is white or other relatively light color while the three dimensional image element 118 is a darker, contrasting color. Where the three dimensional image element 118 includes a logo 130 provided on a background sheet 132, the three dimensional image element may be provided in a first color, the background sheet in a second color and the outer shell in a third color. In one possible embodiment all three colors are different in order to contrast and set forth a particular image outline 122. In another possible embodiment the second and third colors of the background sheet 132 and outer shell 112 are one color while the first color of the image element 118 is different. Often, the image element 118 is provided in a darker color which in some embodiments has a tendency to show through the lighter, covering color of the outer shell 112 thereby enhancing the 3D or holographic effect provided to the image outline 122. In yet another possible embodiment the first and third colors of the image element 118 and outer shell 112 are the same while the color of the front face 120 of the pad 116 is different.

Figure 10:
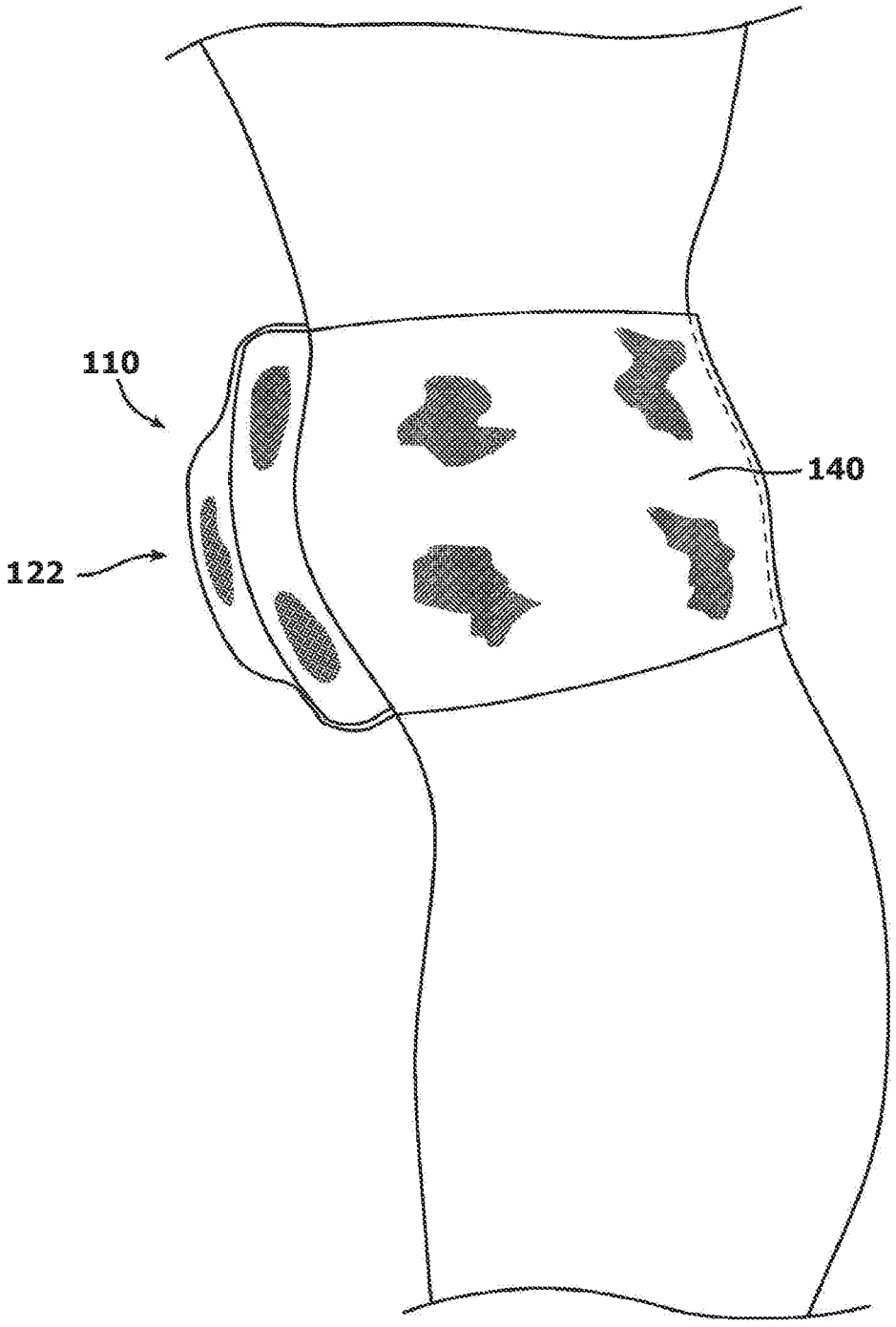
FIG. 10 is a perspective view of the sports pad secured to a knee of an individual.
Figure 11:
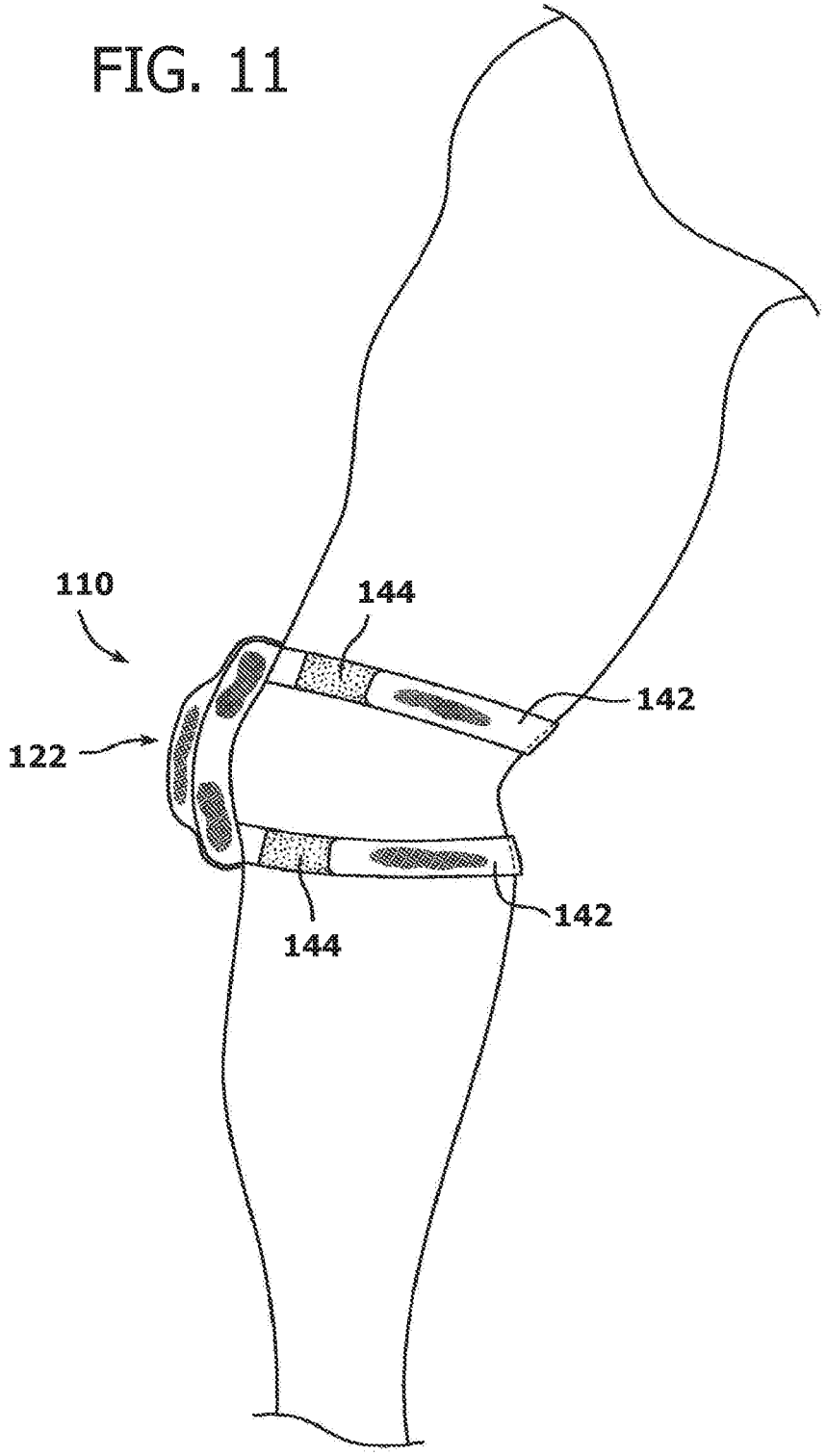
FIG. 11 is a perspective view of the sports pad secured to an elbow of an individual.

As best illustrated in FIGS. 6, 10 and 11, the sports pad 110 further includes a fastener for securing the pad 110 to a limb of an individual. As illustrated in FIG. 6, that fastener 140 comprises a partial or full elastic sleeve. Where the pad 110 is configured, sized or molded to a shape to protect and be worn over a knee, an individual inserts his foot through the fastening sleeve 140 and pulls the pad up in position so that the pad 110 with the 3D image 118 overlies the front of the knee with the elastic sleeve 140 securing the pad in position by wrapping around the back of the knee (see FIG. 10).

In an alternative embodiment the fastener 140 comprises one or more straps 142 with cooperating hook and loop fasteners 144. Where the pad 110 is configured to protect and be worn over an elbow, the pad 116 is positioned over the elbow and the straps 142 are secured with the hook and loop fasteners 144 over the arm on opposite sides of the elbow to hold the straps 142 and sports pad 110 in position with the image outline 122 projecting outwardly from the elbow.

In accordance with an additional aspect, a method of promoting a sports team is provided. That method includes equipping a player on the sports team with a sports pad 110 that includes the three dimensional image element 118 that projects an image outline 122 of a logo, such as a team logo 130, in a desired manner. As indicated above, that logo 130 may be displayed by wearing the pad 110 over a knee and/or over an elbow as desired.

The foregoing has been presented for purposes of illustration and description. It is not intended to be exhaustive or to limit the embodiments to the precise form disclosed. Obvious modifications and variations are possible in light of the above teachings. For example, forearm pads and football helmet chin straps may also be provided and are consistent with the teachings presented in this document. All such modifications and variations are within the scope of the appended claims when interpreted in accordance with the breadth to which they are fairly, legally and equitably entitled.

What is claimed is:

1. A three dimensional image element configured to adhesively attach to a front face of a protective sports pad for ornamenting the protective sports pad, the three dimensional image element consisting of:

a three dimensional shape consisting of a foam layer, the three dimensional shape having a first side, a second side opposite the first side, and an outer perimeter, wherein the three dimensional shape comprises a thickness of 3 mm measured between the first side and the second side;

a background sheet consisting of a foam layer, the background sheet having a third side and a fourth side, wherein the fourth side is opposite the third side, wherein the second side of the three dimensional shape is adhesively attached to the third side of the background sheet such that a border portion of the background sheet around the outer perimeter of the three dimensional shape is not covered by the three dimensional shape; and a layer of adhesive on the fourth side of the background sheet configured for affixing the three dimensional image element to a protective sports pad.

2. The three dimensional image element of claim 1, wherein the three dimensional shape comprises a letter, entwined letters, a word, a number, a name, or a mascot.

3. The three dimensional image element of claim 1, wherein a surface area of the third side of the background sheet is greater than a surface area of the second side of the three dimensional shape.

4. The three dimensional image element of claim 1, wherein the foam comprises a closed cell foam.

5. A sports pad system comprising:

the three dimensional image element of claim 1; and the protective sports pad, wherein the layer of adhesive of the three dimensional image element is attached to a front face of the pad.

6. The system of claim 5, wherein the pad comprises one of: a knee pad, an elbow pad, a shin guard, and a thigh pad.

7. The system of claim 5, wherein the pad is configured to be worn under a layer of fabric, and wherein the three dimensional image element contacts an inner surface of the layer of fabric such that an outer face of the outer fabric shell provides an image outline of the three dimensional image element.

8. The three dimensional image element of claim 1, wherein the three dimensional shape is made from one of polyethylene foam, polypropylene foam, and PVC foam.

9. The three dimensional image element of claim 1, wherein the background sheet comprises a thickness of 3 mm measured between the first side and the second side, and wherein the background sheet comprises a thickness of 3 mm measured between the third side and the fourth side.

10. A three dimensional image element configured to adhesively attach to a front face of a protective sports pad for ornamenting the protective sports pad, the three dimensional image element consisting of:

a three dimensional shape consisting of a foam layer, the three dimensional shape having a first side, a second side opposite the first side, and an outer perimeter;

a background sheet consisting of a foam layer, the background sheet having a third side and a fourth side, wherein the fourth side is opposite the third side, wherein the second side of the three dimensional shape is adhesively attached to the third side of the background sheet such that a border portion of the background sheet around the outer perimeter of the three dimensional shape is not covered by the three dimensional shape, wherein the background sheet comprises a thickness of 3 mm measured between the third side and the fourth side; and a layer of adhesive on the fourth side of the background sheet configured for affixing the three dimensional image element to a protective sports pad.

11. The three dimensional image element of claim 10, wherein the background sheet comprises an outer perimeter, and wherein the outer perimeter of the background laterally surrounds the outer perimeter of the three dimensional shape.

12. The three dimensional image element of claim 10, wherein the background sheet is made from one of polyethylene foam, polypropylene foam, and PVC foam.

13. The three dimensional image element of claim 10, wherein the three dimensional shape comprises a letter, entwined letters, a word, a number, a name, or a mascot.

14. The three dimensional image element of claim 10, wherein a surface area of the third side of the background sheet is greater than a surface area of the second side of the three dimensional shape.

15. A three dimensional image element configured to adhesively attach to a front face of a protective sports pad for ornamenting the protective sports pad, the three dimensional image element consisting of:

a three dimensional shape consisting of a foam layer, the three dimensional shape having a first side, a second side opposite the first side, and an outer perimeter;

a background sheet consisting of a foam layer, the background sheet having a third side and a fourth side, wherein the fourth side is opposite the third side, wherein the second side of the three dimensional shape is adhesively attached to the third side of the background sheet such that a border portion of the background sheet around the outer perimeter of the three dimensional shape is not covered by the three dimensional shape; and a layer of adhesive on the fourth side of the background sheet configured for affixing the three dimensional image element to a protective sports pad.

16. The three dimensional image element of claim 15, wherein the first side of three dimensional shape is tapered from a central area toward the outer perimeter such that the central area projects outwardly a greater distance from the background sheet than does the outer perimeter.

17. The three dimensional image element of claim 15, wherein:

the three dimensional shape comprises a first thickness between the first side and the second side;

the background sheet comprises a second thickness between the third side and the fourth side; and the first thickness is greater than the second thickness.

18. The three dimensional image element of claim 15, wherein the three dimensional shape comprises a letter, entwined letters, a word, a number, a name, or a mascot.

19. The three dimensional image element of claim 15, wherein a surface area of the third side of the background sheet is greater than a surface area of the second side of the three dimensional shape.

* * * * *